United States Patent [19]

Korb et al.

[11] 4,057,817

[45] Nov. 8, 1977

[54] FILM PROCESSOR STANDBY CONTROL SYSTEM

[75] Inventors: A. Norman Korb, Portland; Rex L. Breunsbach, Mulino, both of Oreg.

[73] Assignee: Lok-A-Bin Systems, Inc., Portland, Oreg.

[21] Appl. No.: 629,997

[22] Filed: Nov. 7, 1975

[51] Int. Cl.[2] ..... G03D 13/00

[52] U.S. Cl. ..... 354/298; 250/561; 250/571

[58] Field of Search ..... 354/297, 298, 299, 307; 250/559, 560, 561, 571, 578; 356/202, 203, 205, 206, 209, 226

[56] References Cited

U.S. PATENT DOCUMENTS

| | | | |
|---|---|---|---|
| 3,472,143 | 10/1969 | Hixon et al. | 354/298 |
| 3,561,344 | 2/1971 | Frutiger et al. | 354/298 |
| 3,673,419 | 6/1972 | Aasen | 250/561 X |
| 3,686,510 | 8/1972 | Korb | 307/149 |
| 3,787,689 | 1/1974 | Fidelman | 354/298 X |
| 3,787,702 | 1/1974 | Hujer et al. | 250/561 |
| 3,852,793 | 12/1974 | McClintock | 354/299 X |

*Primary Examiner*—Fred L. Braun

*Attorney, Agent, or Firm*—Klarquist, Sparkman, Campbell, Leigh, Hall & Whinston

[57] ABSTRACT

A standby control attachment for an x-ray film processor uses infrared light reflection to detect the presence of a film in the infeed tray of the processor. A trigger circuit produces a control signal to activate a timer when film is detected. The timer operates processor control relays to switch processor components from a normal standby mode to a processing mode only for a preset timing interval to minimize water and energy consumption and processor wear. Multiple infrared detectors, each with its own trigger circuit, are arranged above the tray and across the film path so that detection of film by one or more of the detectors activates the timer. Control signals from the separate trigger circuits are also applied to auxiliary control devices, one of which activates a darkroom interlock system to lock darkroom access doors and break its white light circuit when film is in the tray. Others of the auxiliary control devices can be used singly or in series to count or measure the surface area of film processed for use in controlling processor chemical replenishment, silver recovery or other processor-related functions.

15 Claims, 3 Drawing Figures

FILM PROCESSOR STANDBY CONTROL SYSTEM

BACKGROUND OF THE INVENTION

1. Field of the Invention

The present invention relates to a standby system for controlling the operation of a film processor and related functions and more particularly to a standby control system which normally maintains the processor in a standby or idle condition but switches it to a full-on processing condition for a predetermined period of time when a film to be processed is detected in the processor infeed tray.

2. Description of the Prior Art

Standby control systems are known which control the operating mode of film processors by maintaining them normally in a standby mode and switching them to a processing mode only when film is detected in the processor infeed tray. Most of such prior standby systems, however, use mechanical detectors which physically touch the film in the infeed tray to detect its presence. However, such mechanical detectors are notoriously unreliable and require frequent adjustment.

A further disadvantage of some known standby control systems for film processors is that they often require extensive modification of the processor components such as infeed switches, signal pickup devices and infeed tray.

One known processor for processing lithographic film uses infrared light transmitted through the film to a receiver to detect the film's presence and thereby initiate a control function of the processor. The disadvantage of such a film detection means is that it requires that the standby system be built into the processor during its manufacture. Therefore it cannot be applied to existing processors. Furthermore, because of its built-in characteristics, such a standby control system lacks flexibility and versatility.

Accordingly, there is a need for a standby control system for film processors which does not rely on mechanical sensors for detecting the presence of film in the processor infeed tray, which is reliable in operation, which requires a minimum of adjustment, which can be embodied either as an attachment to existing processors with a minimum of modification of such processors, or as a built-in component of new processors during their manufacture, and which has flexibility in that it is adaptable for use in controlling other processor-related functions.

SUMMARY OF THE INVENTION

The present invention is a film processor standby control system which detects the presence of film in the processor infeed tray to switch the processor from a standby to a processing mode using infrared reflection. Detection by infrared beam reflection is accomplished using detectors comprising multiple pairs of infrared beam emitters and sensors mounted in a sensor unit which is attached to the opposite sides of the infeed tray to position the detectors above the tray surface in a line across the path of travel of the film. Each infrared sensor is capable of discriminating between the tray surface and a film surface and producing an electrical signal to trigger a control signal which activates a timer to switch, through processor control devices, processor components from a standby to a full-on processing mode for the duration of the timing interval. The control signals also initiate auxiliary control means for controlling the operation of other processor-related functions including a darkroom interlock system, film counting, film area measurement and the like.

A primary object of the invention is to provide a film processor standby control system which is reliable in operation.

Another primary object is to provide a standby control system as aforesaid which, when once adjusted, will not easily go out of adjustment.

Another primary object is to provide a standby system as aforesaid which is easily adjustable to detect the presence of a thin film of only a few thousandths of an inch thickness using infrared light reflection.

Another important object is to provide a standby control system as aforesaid which is embodied in an attachment for existing processors.

Another important object is to provide a standby control system as aforesaid which can be applied to existing film processors with a minimum of modification and with no modification of the processor infeed tray.

Another important object is to provide in a film processor a standby control system which can also be used to control other devices or systems simultaneously with the control of the operating mode of the processor.

A more specific object is to provide in a film processor a standby control system for controlling both the operating mode of the film processor and a darkroom access door, white light and film bin interlock system.

Another specific object is to provide a standby control system for a film processor as aforesaid which also has the capability of counting the film in the processor and measuring the surface area of the film processed for use in controlling other processor-related functions such as chemical replenishment and silver recovery.

The foregoing and other objects, features and advantages of the invention will become more apparent from the following detailed description which proceeds with reference to the accompanying drawings.

DETAILED DESCRIPTION

Figure 1:
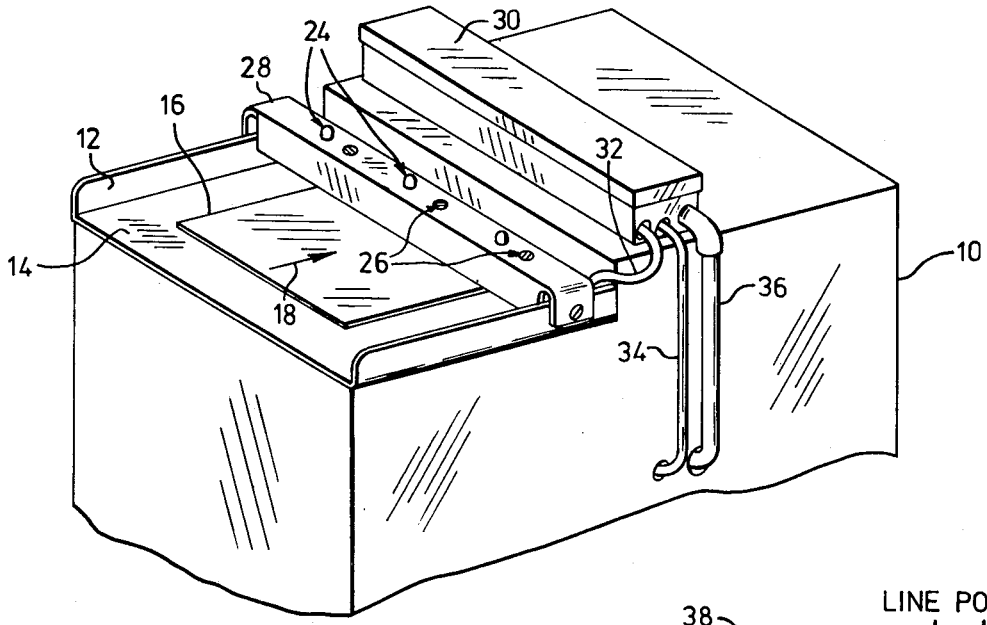
FIG. 1 is a perspective view of an upper portion of a typical x-ray film processor with a standby control system in accordance with the invention mounted thereon.

Referring first to FIG. 1, an x-ray film processor 10 includes a processor infeed tray 12 having a tray surface 14 on which an x-ray film 16 to be processed is placed and thereafter fed by driven rolls (not shown) in the direction of arrow 18 into the film-processing mechanism of the processor for development of the film.

Figure 2:
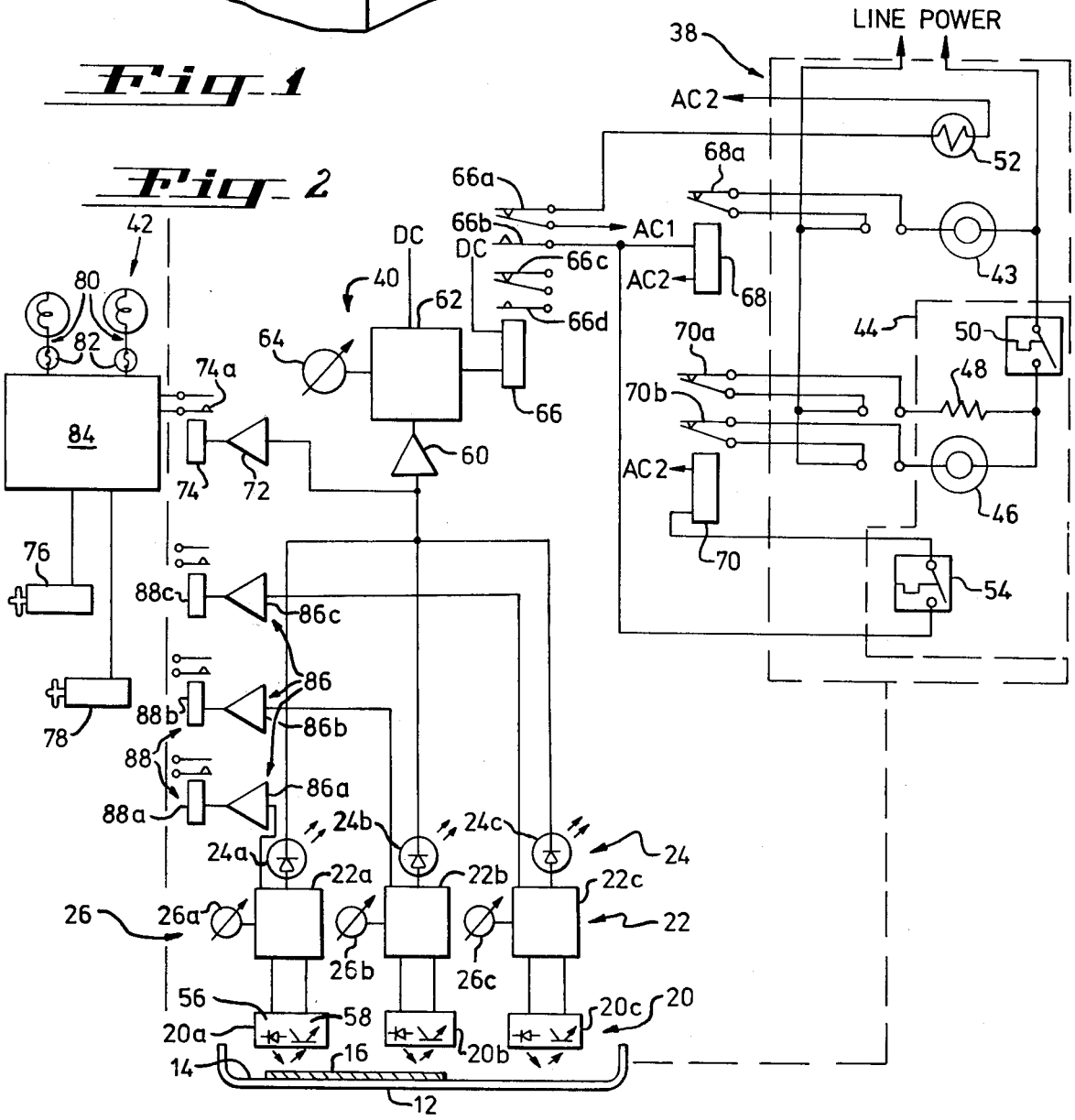
FIG. 2 is a generalized circuit diagram showing the standby control system of FIG. 1 as applied to a film processor, a darkroom interlock system, and auxiliary control devices.
Figure 3:
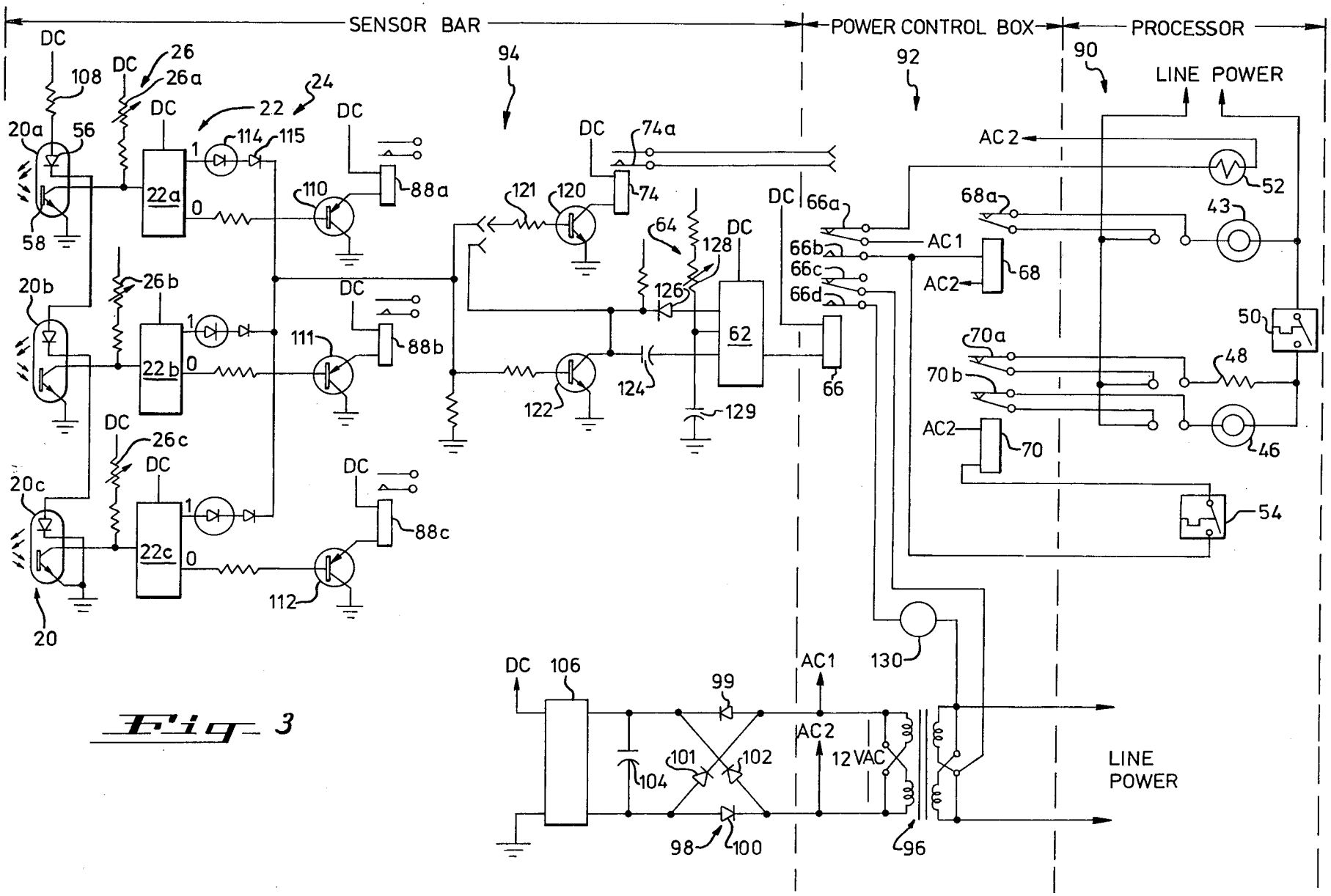
FIG. 3 is an electrical circuit diagram of a standby control system in accordance with the invention as applied to a film processor and auxiliary control devices.

An infrared reflective light film detector means, indicated generally at 20 in FIG. 2, controls signal-triggering means 22 which produces one or more control signals to initiate certain control functions to be described. These means together with trigger-indicating means 24 and sensitivity adjusting means 26 are all mounted within a housing in the form of a film sensor bar 28. Bar 28 extends across upper surface 14 of processor infeed tray 12 and attaches at its opposite ends to the upright sides of the tray as shown in FIG. 1. Other electrical components of the standby control system for the processor, as delineated in FIG. 3, are mounted in a power control box 30 mounted on a top surface of processor 10 just to the rear of infeed tray 12. A sheathed cable conduit 32 houses electrical conductors electrically interconnecting components within the sensor bar to control system components within the power control box. A low-voltage cable conduit 34 leads conductors from control box 30 through a sidewall of the processor housing into its interior to connect with an electrically operated water restricter valve and an auxiliary thermostat within the processor housing, the functions of which will be described later. Another cable conduit 36 leads conductors from power control box 32 to a heater and roller drive motor within the processor housing for controlling these processor components.

Referring now to the logic diagram of FIG. 2, such diagram is subdivided to indicate control system and controlled components located within the film processor itself, indicated schematically at 38, control components located within separate film detection and standby control unit attachments, namely sensor bar 28 and power control box 30, indicated generally at 40, and controlled components of a known darkroom interlock system indicated generally at 42.

The typical x-ray film processor for which the control system is intended includes roller drive motor 43 which drives the rolls which feed the x-ray film from the infeed tray through the processor only during the processing mode, and a film-drying chamber 44. The drying chamber includes an air blower driven by a blower motor 46, and a heater 48, the operation of both of which are controlled by a main thermostat 50 in the processing mode to maintain a predetermined temperature range in the chamber.

The standby system includes an electrically operated water flow-restricting valve 52 having a variable flow-restricting position and a full flow position. In the standby condition of the processor, restriction valve 52 is maintained in its flow-restricting position to restrict water flow to a level just sufficient to keep the processing chemicals at a temperature sufficient for instant use upon switching of the processor to its processing mode. In the processing condition of the processor, water restriction valve 52 is maintained in its full-open position to enable full water flow through the water-circulating system of the processor to maintain the processing chemicals in proper condition for processing.

With the standby control system of the invention, the conventional processor is also modified to include an auxiliary standby thermostat 54 in drying chamber 44. The standby thermostat has a somewhat lower operating range than main thermostat 50 and functions during the standby mode to operate heater 48 and blower motor 46 intermittently to maintain a predetermined acceptable low-level temperature range in the drying chamber in the standby mode.

The standby operating mode of the processor thus serves to maintain the processor in condition for immediate processing of film when film to be processed is placed in the infeed tray of the processor but minimizes drain of electrical power, water consumption and wear of processor components.

The input portion of the standby control system which determines the operating mode of the processor includes the previously mentioned infrared detection means 20. Such means includes multiple infrared light beam emitters 56 paired with a corresponding number of infrared beam receivers or sensors 58. In the illustrated embodiment there are three such infrared detector means 20*a*, 20*b* and 20*c*. The infrared emitter of each pair is mounted in a fixed position above the top surface 14 of tray 12 to direct an infrared light beam at a reflective angle toward such surface or the interposed surface of a film on the tray. Each infrared beam sensor 58 is positioned to receive the reflected infrared beam from its paired emitter, also at a fixed position above the surface of tray 12.

A detection signal is produced by each of the infrared sensors 58 upon receiving a reflected infrared beam from its corresponding emitter 56. Such detection signal is applied through a conductor to a corresponding triggering means 22, there being three such triggering means 22*a*, 22*b* and 22*c* shown, corresponding to the three infrared detector means 20*a*, 20*b* and 20*c* respectively. Each such triggering means in the illustrated embodiment comprises a Schmitt trigger integrated circuit which produces a control signal only when the infrared sensor 58 applies a detection signal which is at a predetermined threshold level sufficient to trigger such circuit.

The predetermined threshold level is set by a sensitivity adjusting means 26, there being a separate such sensitivity control 26*a*, 26*b*, 26*c* for each corresponding trigger circuit 22*a*, 22*b*, 22*c*. The sensitivity control is adjusted so that the detection signal from the corresponding sensor enables the Schmitt trigger circuit to produce a control signal only when a film 16 to be processed is present on the tray in the path of the infrared beam from the corresponding emitter, thus indicating the presence of film on the tray. Each trigger circuit is also provided with a corresponding trigger indicator light 24*a*, 24*b*, 24*c* which emits visible light only when a control signal is triggered by the corresponding trigger circuit. Thus each of the trigger indicator lights 24 can be used in conjunction with its sensitivity control 26 to adjust the detection signal to trigger the corresponding trigger circuit 22 only when film is present on the tray. Once properly adjusted in a particular environment and installation, the trigger circuits should not require further adjustment. It has been found that using infrared reflection as described, the detection signal can be adjusted so that the sensor not only discriminates between the tray surface and the surface of a film only a few thousandths of an inch thick, but also discriminates between processed (black) and unprocessed (green) film to trigger a control signal only when unprocessed film is present on the tray.

An output control signal from any one of the three triggering circuits 22 is applied to a buffer amplifier and signal inverter means 60 which in turn transmits a control signal to a timing means 62. Timer 62 is thereby activated for a predetermined adjustable time interval as determined by the setting of a time interval control means 64.

Timer 62 controls the operation of processor control means comprising a primary processor control relay 66 and secondary processor control relays 68, 70. Such relays are shown in FIGS. 2 and 3 with their contacts positioned in their processing mode, assuming the timer is activated. Primary relay 66 includes relay contacts 66*a*, 66*b*, 66*c*, and 66*d*. Contact 66*b* of the primary relay controls the operation of secondary relays 68, 70, the latter through standby thermostat 54. Relay 68 includes a relay contact 68*a* which controls the operation of roller drive motor 43. Relay 70 includes a first contact 70*a* controlling operation of heater 48 in conjunction with main thermostat 50. A second relay contact 70*b* controls the operation of blower motor 46 in conjunction with main thermostat 50. The contact 66*a* of relay 66 controls the operation of the water flow restriction valve 52.

OPERATION

In FIGS. 2 and 3 the processor is shown in its processing mode with timer 62 activated. In such mode a second control signal from the activated timer 62 is applied to the primary processor control relay 66 in response to the first control signal triggered by one or more of the trigger circuits 22. This de-energizes relay 66 which is normally energized in its standby mode, closing contact 66*a* to open water valve 52 to its full-flow position and opening contact 66*b* to de-energize relays 68, 70. With relay 68 de-energized, relay contact 68*a* closes to operate roller drive motor 43. With relay 70 de-energized, relay contact 70*a* closes to operate heater 48 if main thermostat 50 is also closed indicating a low temperature in the drying chamber. Relay contact 70*b* also closes to operate blower motor 46, but again only if main thermostat 50 is also closed. Thus main thermostat 50 controls operation of both the heater and blower in the processing mode. Roller drive motor 43 operates continuously and water valve 52 remains wide open in this mode.

When the timing interval of timer 62 is completed and assuming in the meantime that no additional film is received in infeed tray 12, relay 66 is automatically reenergized, opening contact 66*a* to close valve 52 to its restricted flow position and closing contact 66*b* to reenergize secondary relay 68. With relay 68 reenergized, relay contact 68*a* reopens to shut off roller drive motor 43.

The closing of contact 66*b* also reenergizes relay 70, but only if the standby thermostat 54 is closed indicating a lower than desired temperature in the drying chamber. When thermostat 54 closes to energize relay 70, blower motor 46 and heater 48 operate until the drying chamber is heated to its standby temperature range. When this occurs, thermostat 54 reopens to de-energize relay 70 and reopen contacts 70*a* and 70*b* to shut off the heater and blower motor. Thus in the standby condition of the processor, heater 48 and blower motor 46 operate intermittently for short periods of time so as to maintain a predetermined minimum standby temperature range within the film-drying chamber.

It will be apparent from FIG. 2 that timer 62 is activated whenever any one or more of the infrared detectors 20 detects a film 16 in infeed tray 12 of the processor. Timer 62 can be adjusted by the interval-adjusting means 64 to maintain the processor in a processing mode for as long as necessary to complete the processing of an x-ray film in a particular processor.

The triggering of any one or more of the trigger circuits 22 to generate a control signal also applies such signal to relay driver means 72 to activate an interlock control means comprising the interlock control relay 74.

The darkroom interlock system, indicated schematically at 42, is a well-known system manufactured by Lok-A-Bin Systems, Inc., of Portland, Oreg. One such interlock system is disclosed in detail in U.S. Pat. No. 3,686,510, issued Aug. 22, 1972. Such system typically includes electrically operated door-locking means 76 for locking the access doors of the darkroom and x-ray film bin drawer-locking means 78 for locking the film bins in which unexposed x-ray film is stored. Such system also includes a white light circuit 80 for the darkroom including electrically operated circuit breaking means 82. Such darkroom interlock system also includes electrically operated interlocking means indicated schematically at 84 which operates to activate the bin drawer locks 78 to lock the film bin drawers whenever either an access door is open or the white light circuit is energized so as to prevent inadvertent exposure of unexposed x-ray film to a white light source. Such interlock system also includes means for activating the door-locking means 76 and the circuit breaker means 82 to lock the access doors closed and turn off the white lights whenever a film bin drawer is opened.

The standby system of the present invention is adapted to intertie the aforesaid interlock system 42 with the film processor. Thus whenever an x-ray film 16 is detected by infrared reflection in the infeed tray 12 of the processor by any one or more of the infrared detectors 20, a control signal generated by one or more of the triggering circuits 22 is applied through relay driver 72 to interlock control relay 74 to energize such relay and close its contacts 74*a*. Contacts 74*a* are operably connected to interlock control 84 to activate door-locking means 76 to lock the access doors closed and simultaneously to activate circuit breakers 82 to turn off the white lights in the darkroom. In this way film to be processed is not damaged by any unintended white light in the darkroom.

When a film 16 is no longer present in the tray but is safely within the processor and therefore no longer detected by one or more of detectors 20, triggering circuits 22 no longer trigger a control signal. Thus relay 74 is de-energized immediately, reopening contacts 74*a*, deactivating door locks 76 and circuit breakers 82 to once again permit access to the darkroom and restore the white light circuits.

The standby control system as described is also capable of controlling the operation of auxiliary processor-related functions or even independent functions. For this purpose each trigger circuit 22 is connected through auxiliary relay driver means 86 to auxiliary control devices 88 for controlling auxiliary functions which may or may not be related to the processor. Each trigger circuit 22*a*, 22*b*, 22*c* includes its own separate gating means 86*a*, 86*b*, 86*c*. These in turn operate separate auxiliary control relays 88*a*, 88*b*, 88*c*. Thus, for example, when trigger circuit 22*a* is triggered by detector 20*a*, only the auxiliary control relay 88*a* is activated. Similarly when trigger circuits 22*b* and 22*c* are activated independently, only their respective control devices 88*b* and 88*c* are activated. One or all of the auxiliary control devices can be activated at once, depending on how many and which combination of infrared detectors 20 detect film on the infeed tray.

With separate auxiliary control devices associated with each trigger circuit and detector, auxiliary controlled devices (not shown) can be connected to counting means or film area measurement means (not shown) for counting the total number of films processed or for recording the total film area processed. This information can in turn be used to control, for example, chemical replenishment in the processor since the need for chemical replenishment is proportional to the total area of film processed. Area is determined by counting the number of films passing through the infeed tray and also the width of film. Since the feed rate of a processor can be determined, the length and width of each film can be determined by counting the number of sensors activated and by measuring the time interval during which they remain activated.

Silver recovery from the fixer solution can also be controlled using the same technique since the approximate silver content of the fixer solution can be calculated from the total area of film processed. By this means a known silver reclaiming system may be automatically controlled to process the fixer solution for optimum silver recovery.

Standby Control Circuit

FIG. 3 is an electrical circuit diagram showing typical electronic components and circuitry which may be used to carry out the control system functions described with respect to FIGS. 1 and 2. The portion of the circuitry shown at 90 is located in the processor itself. The portion of the circuitry shown at 92 is located within the power control box 30 mounted on top of the processor. The remaining portion of the circuitry indicated at 94 is located in the sensor bar 28 attached to the infeed tray of the processor.

The power control box 30 includes a transformer 96, the primary terminals of which are connected to a source of line power within the processor. Movable straps allow connection of the transformer to, for example, either a 120 v. or 240 v. a.c. 60 Hz source. Typically, 12-volt a.c. terminals of the transformer are connected to a bridge rectifier 98 comprising diodes 99, 100, 101 and 102. The resulting d.c. voltage from the rectifier is smoothed by a capacitor 104 before being applied to typically a 15 v. regulator 106. The regulated 15 v. output from regulator 106 is used to power all circuits in the film detector and timer portions of the circuitry. The 12 v. a.c. output powers the remaining portions of the processor control circuitry.

The infrared emitters 56 of the film detectors 20 each comprise a light-emitting diode. The infrared sensors 58 of the detectors 20 each comprise a photo-sensitive transistor. The diodes receive operating current from the 15 v. supply through a current-limiting resistor 108. Infrared radiation from the diodes is reflected from the surface of the film tray or a film on the tray, and impinges on the junction of transistor sensor 58.

In the illustrated circuit the sensitivity controls 26 of FIG. 2 comprise variable resistors **26*a*, 26*b*, 26*c* which determine the collector current to the phototransistors 58 and set the threshold voltage at which the Schmitt trigger integrated circuits 22** trigger a control signal. The variable resistors are also used to adjust for differences in detector characteristics and to compensate for varying ambient light conditions.

During operation, a film passing under a detector 20 causes an increase in the collector current of one or more of phototransistors 58, dropping the voltage at the corresponding Schmitt trigger inputs. Thus the activated trigger circuit assumes another state for the duration of the film present on the infeed tray, and the voltage at the "zero" output terminal of the triggered Schmitt trigger circuit drops, activating a corresponding PNP transistor 110, 111 or 112. As a result, collector current at such transistor rises, and this is applied to the corresponding auxiliary control relay **88*a*, 88*b* or 88*c*** to close its relay contacts and initiate an auxiliary control function as previously described.

Still assuming that one or more of detectors 20 senses a film in the infeed tray, causing trigger circuits 22 to change state, the voltages on the activated trigger circuit terminals "one" increase. This control signal is applied to corresponding coupling diodes 114, 115, diode 114 of which is a light-emitting diode which serves as the trigger indicating means 24 of FIG. 2. The increased voltage from the coupling diodes is applied to the base of a transistor 120, activating it to energize interlock control relay 74 to close its relay contact **74*a* and operate the darkroom interlock system previously described. The operation of the relay could be inverted if desired by moving the strap on a resistor 121 from the base to the collector of transistor 120**.

A second transistor 122 is also energized in the same manner as transistor 120 whenever a control signal is triggered by any one or more of the trigger circuits 22. As the base voltage of transistor 122 increases, its collector voltage drops, activating the circuit of timer 62. The resulting control signal from timer 62 in turn deenergizes the normally energized primary processor control relay 66 to position its relay contacts as shown and operate the secondary processor control relays 68, 70 and processor control circuitry in the manner previously described with respect to FIG. 2. The collector of transistor 122 is coupled to the timing circuit input by both direct current and alternating current via the capacitor 124 and diode 126 respectively. In this way trigger control signals occurring during a timing interval will restart timer 62, thereby ensuring that the processor will operate for an adequate time to process all film placed in the infeed tray.

Variable resistor 128 and capacitor 129 comprise a charging circuit which determines the desired timing interval. Variable resistor 128 functions as the interval timing control 64 referred to in FIG. 2. Variable resistor 128 is adjusted by the operator for an interval sufficient to process a film, depending on the requirements of the particular processor.

The conditioning of the processing circuitry and components at 92 in FIG. 3 when the timer is inactive and active has already been described with reference to FIG. 2, and therefore need not be repeated here. Accumulated standby time may be recorded by a running time meter 130 which is turned on upon the closing of relay contact **66*d*, which occurs only when relay 66 is energized, that is, in the standby condition of the processor when timer 62** is inactive. If desired, another time indicator (not shown) may be added to record accumulated time during which the processor remains energized in both operating modes.

Having illustrated and described the principles of the invention with reference to the processing of x-ray films and to what is presently a preferred embodiment, it should be apparent to those skilled in the art that the invention may be applied to the processing of other types of film and may be modified in arrangement and detail without departing from such principles. It is intended to claim as part of the invention all such modifications as come within the scope of the following claims.

We claim:

1. In a standby unit for controlling the operating mode of a film processor so that said processor is normally maintained in a standby mode and is switched to a processing mode for a predetermined film-processing period only in response to the presence of a film on the infeed tray of the processor, the improvement comprising:

infrared light-emitting means for emitting a beam of infrared light from a position spaced above the processor infeed tray toward the film-supporting surface of said tray at a reflective angle, infrared light-sensing means for spaced positioning above the tray surface in the path of reflection of said infrared beam and operable to generate an electrical detection signal in response to the sensing of said reflected beam, with said detection signal varying depending on the presence or absence of a film on said tray in the path of said infrared beam, and triggering means for generating a derived control signal for controlling an operating function of the standby unit in response to the application of said detection signal to said triggering means at a predetermined threshold level indicating the presence of a film on said tray, multiple said emitting means and multiple said sensing means with each one of said multiple emitting means being arranged in a pair with a corresponding one of said multiple sensing means, said pairs being mounted and arranged for attachment to a film processor above the infeed tray thereof in a position such that said multiple pairs extend in a line normal to the path of travel of a film on said tray, a separate said triggering means operably connected to each said pair of infrared emitting means and infrared sensing means such that a detection signal applied by any one of said pairs at said predetermined threshold level will trigger a corresponding one of said triggering means to produce a corresponding said control signal and such that detection signals applied simultaneously by multiple said pairs to their corresponding said triggering means at said predetermined threshold level generate a corresponding number of separate said control signals.

2. In a standby unit according to claim 1, the improvement comprising sensitivity adjusting means for adjusting said predetermined threshold level of said variable detection signal necessary to trigger said triggering means so as to generate said derived control signal.

3. A standby unit according to claim 2 wherein said sensitivity adjusting means includes a visible light-emitting means operable in response to the generation of said control signal by said triggering means for use as an aid in predetermining the desired said threshold level of said detection signal.

4. A standby unit according to claim 1 wherein said infrared light-emitting means comprises an infrared light-emitting diode and said infrared light-sensing means comprises an infrared light-sensitive phototransistor.

5. In a standby unit according to claim 1, the improvement comprising a timer means operable in response to the generation of said control signal by said triggering means to generate a second control signal for controlling the operation of a connected processor for a predetermined period of time.

6. In a standby unit according to claim 5, the improvement comprising gating means between said triggering means and said timer means operable to apply a third control signal to said timer means to energize said timer means upon the application of said first control signal from said triggering means to said gating means.

7. In a standby unit according to claim 5, the improvement comprising relay control means operated by the application of said second control signal by said timer means for controlling the operating mode of a connected film processor.

8. In a standby unit according to claim 1, the improvement comprising multiple control means, each of said multiple control means being operated in response to a said control signal generated by a different one of said separate triggering means such that each of said multiple control means are operable independently of one another.

9. In a standby unit according to claim 1, the improvement comprising timer means operable in response to the generation of a said control signal by any one of said multiple triggering means to generate a second control signal for a predetermined period of time for controlling the switching of a film processor to its processing mode for said predetermined period of time.

10. In a standby unit according to claim 9, the improvement comprising multiple control means in addition to said timer means for controlling processor-related functions other than the operating mode of said processor, each of said multiple control means being operable in response to the generation of a said control signal by a different one of said multiple triggering means and independently of the operation of said timer means and each other such that each of said control means remains activated only so long as a corresponding said triggering means continues to generate its said control signal and therefore only so long as the corresponding one of said pairs of emitting and sensing means continues to sense a film on the processor infeed tray.

11. In a standby unit according to claim 10, the improvement comprising each of said multiple triggering means being operatively connected to the same said timer means and also being operably connected to a different one of said multiple control means such that upon generation of a said control signal by any one of said triggering means, said one triggering means activates said timer means and a corresponding one of said multiple control means.

12. In combination, a film processor and a standby unit for controlling the operating mode of said processor such that said processor is normally maintained in a low energy consuming standby mode and is switched to a high energy consuming processing mode only for a predetermined processing period in response to the presence of a film in the infeed tray of said processor, said processor including water-circulating means, a drive motor and a film-drying chamber including a blower means, a heater and a main thermostat controlling the operation of said heater and blower means, said standby unit including electrically operated processor control means normally operable to maintain said processor in its standby mode wherein said drive motor is deactivated and said blower means and heater are deactivated, a timer means for controlling the operation of said processor control means, film detector means for detecting the presence of a film in said infeed tray and timer-activating means for activating said timer means for a predetermined period in response to a sensing of a film in said tray by said detector means, said detector means comprising infrared light emitter means positioned above said tray and directed toward said tray for reflecting an infrared light beam from an upper surface of said tray or a film in said tray and means positioned and operable for sensing the reflected beam and differentiating between said beam when reflected from said tray surface and when reflected from said film surface by producing a variable level detection signal representative of said differentiation, and triggering means for producing a control signal in response to the application of said detection signal to said triggering means at a threshold level indicative of the presence of a film in said tray, and means for operating said timer means in response to the application of said control signal, said timer means being operable when activated to operate said processor control means in a manner to switch said processor from its standby mode to its processing mode for said predetermined period during which said drive motor, blower means and heater are activated and controlled by said main thermostat, said processor including a water flow-restricting valve means in said water-circulating means with said restricting valve means having a flow-restricting position and a full flow position, said processor control means being operable with said timer means deactivated to maintain said flow-restricting valve means in said flow-restricting position, said processor control means being operable with said timer means activated to operate said restricting valve means in its said full flow position, said film-drying chamber including auxiliary thermostat means having a lower temperature operating range than said main thermostat, said auxiliary thermostat being operable in the standby mode of said processor to operate said processor control means intermittently to activate said heater and said blower means to raise the temperature within said drying chamber when said temperature drops below a predetermined minimum level during said standby mode, said processor control means remaining operable to operate said heater and blower means until said auxiliary thermostat recloses upon the raising of the temperature within said drying chamber within an acceptable standby temperature range.

13. In combination, a film processor and a standby unit for controlling the operating mode of said processor such that said processor is normally maintained in a low energy consuming standby mode and is switched to a high energy consuming processing mode only for a predetermined processing period in response to the presence of a film in the infeed tray of said processor, said processor including water-circulating means, a drive motor and a film-drying chamber including a blower means, a heater and a main thermostat controlling the operation of said heater and blower means, said standby unit including electrically operated processor control means normally operable to maintain said processor in its standby mode wherein said drive motor is deactivated and said blower means and heater are deactivated, a timer means for controlling the operation of said processor control means, film detector means for detecting the presence of a film in said infeed tray and timer-activating means for activating said timer means for a predetermined period in response to a sensing of a film in said tray by said detector means, said detector means comprising infrared light emitter means positioned above said tray and directed toward said tray for reflecting an infrared light beam from an upper surface of said tray or a film in said tray and means positioned and operable for sensing the reflected beam and differentiating between said beam when reflected from said tray surface and when reflected from said film surface by producing a variable level detection signal representative of said differentiation, and triggering means for producing a control signal in response to the application of said detection signal to said triggering means at a threshold level indicative of the presence of a film in said tray, and means for operating said timer means in response to the application of said control signal, said timer means being operable when activated to operate said processor control means in a manner to switch said processor from its standby mode to its processing mode for said predetermined period during which said drive motor, blower means and heater are activated and controlled by said main thermostat, said processor including a water flow-restricting valve means in said water-circulating means with said restricting valve means having a flow-restricting position and a full flow position, said processor control means being operable with said timer means deactivated to maintain said flow-restricting valve means in said flow-restricting position, said processor control means being operable with said timer means activated to operate said restricting valve means in its said full flow position, said processor control means comprising a primary processor control relay means controlled by a signal from said timer means and secondary processor control relay means controlled by signals from said primary processor control relay means, said primary control relay means being operable to control the operation of said restricting valve means in said processor, said secondary processor control relay means being operable to control the operating condition of said drive motor, blower means and heater.

14. In combination, a film processor and a standby unit for controlling the operating mode of said processor such that said processor is normally maintained in a low energy consuming standby mode and is switched to a high energy consuming processing mode only for a predetermined processing period in response to the presence of a film in the infeed tray of said processor, said processor including water-circulating means, a drive motor and a film-drying chamber including a blower means, a heater and a main thermostat controlling the operation of said heater and blower means, said standby unit including electrically operated processor control means normally operable to maintain said processor in its standby mode wherein said drive motor is deactivated and said blower means and heater are deactivated, a timer means for controlling the operation of said processor control means, film detector means for detecting the presence of a film in said infeed tray and timer-activating means for activating said timer means for a predetermined period in response to a sensing of a film in said tray by said detector means, said detector means comprising infrared light emitter means positioned above said tray and directed toward said tray for reflecting an infrared light beam from an upper surface of said tray or a film in said tray and means positioned and operable for sensing the reflected beam and differentiating between said beam when reflected from said tray surface and when reflected from said film surface by producing a variable level detection signal representative of said differentiation, and triggering means for producing a control signal in response to the application of said detection signal to said triggering means at a threshold level indicative of the presence of a film in said tray, and means for operating said timer means in response to the application of said control signal, said timer means being operable when activated to operate said processor control means in a manner to switch said processor from its standby mode to its processing mode for said predetermined period during which said drive motor, blower means and heater are activated and controlled by said main thermostat, darkroom interlock means for controlling the operation of white lights, door locks and film bin locks in a darkroom housing said processor, said darkroom interlock means including means for turning off the white lights in said darkroom and activating said door-locking means when said film bin is opened and being operable to activate said film bin drawer-locking means when said white lights are on and being operable to activate said film bin drawer-locking means when a darkroom door is opened, said standby unit including darkroom interlock control means, said darkroom interlock control means being operable in response to said control signal from said triggering means to activate said interlock means so as to turn off said white lights and activate said door-locking means, said interlock control means being operable as aforesaid independently of said timer means so as to condition said interlock means as aforesaid only during the presence of a film in said processor infeed tray.

15. In combination, a standby control system for controlling the operating mode of a film processor such that said processor is normally maintained in a standby mode and is switched to a processing mode only for a predetermined processing period in response to the presence of a film in the infeed tray of said processor, and a darkroom interlock means for interlocking a white light circuit, access door and film bin drawer of a darkroom in which the processor is located, said interlock means including electrically operated door-locking means, electrically operated bin drawer-locking means and electrically operated white light circuit breaking means, said interlocking means further including means operable to activate said door-locking means to lock said access door and to operate said circuit-breaking means to disable the white lights in response to the opening of said bin drawer, means for activating said bin drawer-locking means to lock said bin drawer in response to the opening of said access door, and means for activating said bin drawer-locking means to lock said bin drawer in response to activation of said white light circuit, said standby control system including film detector means for detecting the presence of a film in the infeed tray of a film processor in said darkroom, and interlock control means operable to activate said interlock means to operate said white light circuit-breaking means to disable said white light circuit and activate said door-locking means to lock said access door in response to the sensing of a film in said infeed tray, said detector means including infrared light emitter means positioned above and directed toward said tray for reflecting an infrared light beam from an upper surface of said tray or a film in said tray, means for sensing the reflected beam and differentiating between said beam when reflected from said tray and when reflected from said film by producing a variable detection signal representative of said differentiation, triggering means for producing a control signal in response to the application of said detection signal to said triggering means at a threshold level indicating the presence of a film in said tray, and interlock control-activating means for operating said interlock control means as aforesaid in response to the application of said control signal to said activating means.

* * * * *